United States Patent [19]

Anthonsen et al.

[11] Patent Number: 4,645,736

[45] Date of Patent: Feb. 24, 1987

[54] WATERPROOF PHOTOGRAPHIC PAPER SUPPORT

[75] Inventors: Reiner Anthonsen, Bramsche; Wieland Sack, Bissendorf; Heinz Trentmann; Hans-Georg Wöllmer, both of Osnabrück, all of Fed. Rep. of Germany

[73] Assignee: Felix Schoeller Jr. GmbH & Co. KG, Osnabrück, Fed. Rep. of Germany

[21] Appl. No.: 783,810

[22] Filed: Oct. 4, 1985

Related U.S. Application Data

[63] Continuation of Ser. No. 565,977, Dec. 27, 1983, abandoned.

[30] Foreign Application Priority Data

Jan. 3, 1983 [DE] Fed. Rep. of Germany ..... 3300025

[51] Int. Cl.[4] ..... G03C 1/86

[52] U.S. Cl. ..... 430/538; 427/35; 427/44; 427/362

[58] Field of Search ..... 430/538; 427/35, 44, 427/362

[56] References Cited

U.S. PATENT DOCUMENTS

| | | | |
|---|---|---|---|
| 2,360,216 | 10/1944 | Fillius | 430/538 |
| 2,366,723 | 1/1945 | Galley | 430/538 |
| 2,415,631 | 2/1947 | Galley | 430/538 |
| 3,525,621 | 8/1970 | Miller | 430/538 |
| 3,669,709 | 6/1972 | Kasugal et al. | 430/538 |
| 3,682,639 | 8/1972 | Barbehem et al. | 430/538 |
| 4,269,937 | 5/1981 | Asamuma et al. | 430/538 |
| 4,283,486 | 8/1981 | Aono et al. | 430/538 |
| 4,322,450 | 3/1982 | Gray et al. | 427/44 |
| 4,352,861 | 10/1982 | von Meer et al. | 430/538 |
| 4,364,971 | 12/1982 | Sack et al. | 427/44 |
| 4,384,040 | 5/1983 | von Meer | 430/538 |

*Primary Examiner*—Jack P. Brammer

*Attorney, Agent, or Firm*—Lockwood, Alex, FitzGibbon & Cummings

[57] ABSTRACT

A multilayer, waterproof photographic paper support includes a paper which is coated with a layer of radiation hardened varnish or varnish color and a barrier layer is positioned between the paper and varnish layer. The barrier layer comprises a polymer, film-forming material, produced either by extrusion coating, a coating of an aqueous solution or dispersion.

33 Claims, 3 Drawing Figures

WATERPROOF PHOTOGRAPHIC PAPER SUPPORT

This application is a continuation of application Ser. No. 565,977 filed Dec. 27, 1983, now abandoned.

BACKGROUND OF THE INVENTION

The present invention relates to a multilayer waterproof photographic paper support of especially high surface smoothness and good photographic properties and a process for its manufacture.

Waterproof coated photographic paper supports of various designs are known. DE-AS No. 14 47 815 describes a paper support for light-sensitive coatings coated on both sides with polyolefin resin. A paper support is described in DE-OS No. 30 22 451 coated on both sides with layers of varnish hardened by electron beams. Finally, DE-OS No. 30 22 709 describes a paper carrier coated with hardenable mixtures, where a coating in contact with a profiling surface is hardened, and which as a result is characterized by high smoothness of surface. The new waterproof varnish coatings hardened by electron beams as described in DE-OS No. 30 22 451 and DE-OS No. 30 22 709 are in particular more scratch-resistant than the hitherto customery polyolefin coatings in accordance with DE-AS No. 14 47 815. The possibility of higher pigmentation is additionally provided, resulting in improved resolution of images and the improvement of the surface structure in accordance with DE-OS No. 30 22 709 contributes significantly to the fact that thinner photographic layers can be uniformly applied. This also results in an improvement of image quality.

A disadvantage of support materials with electron beam-hardened coatings has hitherto been that, with normal storage of photographic products, a minor alteration occurs in the sensitivity of photographic coatings and with more prolonged periods of storage a measurable fog. This disadvantage becomes noticeable after some months of storage.

It has hitherto been unclear why stability in storage is not assured because the starting materials have no measurable influence upon the photographic layers. It is assumed that a photochemically active low-molecular substance or impurity penetrates through diffusion into the photographic coatings and there reacts, after it first became photochemically active through radiation. Such low-molecular substances are contained in the hardenable or still unhardened layer.

In order to counter this disadvantage, the coating hardened by electron beams in accordance with DE-OS No. 30 46 130 was covered with an additional polyolefin layer. Achievement of good surface characteristics in the support storage stability of several months was, thus, successfully achieved and a product suitable for use in normal conditions obtained. However, a disadvantage after printing was a reduction in sharpness of the image occasioned by the polyolefin covering. Also noticeable as a disadvantage in this design arrangement, is the sensitivity to scratching of the polyolefin surface. The durability of the photographic material is, moreover, limited by the polyolefin which is appreciably inferior in resistance to aging relative to the traditional photo supports with barium sulfate coatings.

It is therefore an object of the present invention to create a waterproof and scratch-resistant photographic support element of great durability which not only has a stable, uniformly smooth surface, but also, after an extended period of storage, has no influence upon the sensitivity of superimposed photographic layers and does not cause disturbing fog in the photographic layers.

BRIEF DESCRIPTION OF THE DRAWINGS

To assist better understanding of the construction of the carrier material in accordance with the invention, various embodiments are shown in FIGS. 1–3 in cross-section. The photographic layer is shown in each case in the drawings as 1, and may for its part consist of several layers. An intermediate layer 2 which provides adhesion may be present as the occasion requires. A front varnish layer 3 is solidified by means of electron beams and preferably contains pigment. A front barrier layer is denoted by 4. The photographic base paper denoted by 5 may include a moisture-repelling inner size and/or, as occasion requires, a surface size coating. The back barrier layer is denoted by 6. An additional layer denoted by 7 is hardened by electron beam. An additional functional rear layer, e.g. an antistatic coating, is denoted by 8.

DESCRIPTION OF THE PREFERRED EMBODIMENTS

Figure 1:
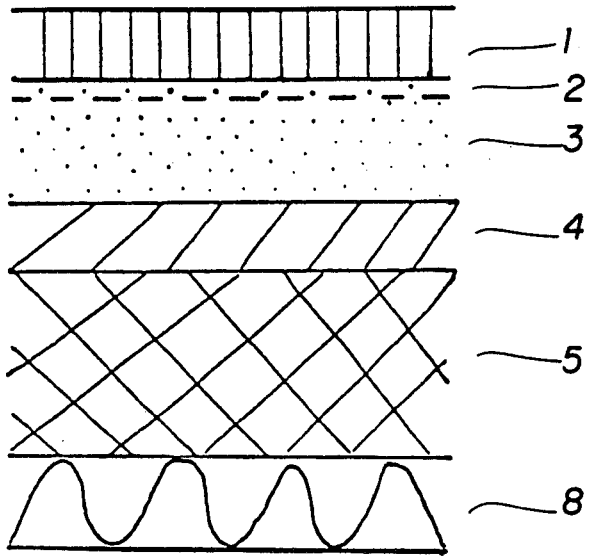
Figure 2:
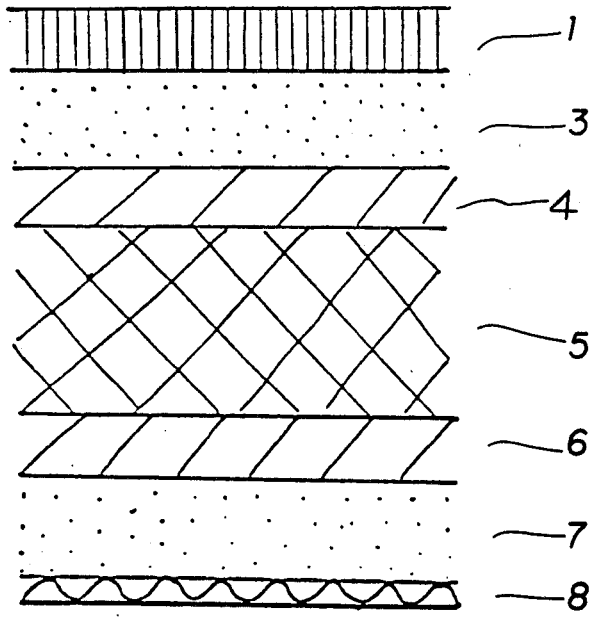
Figure 3:
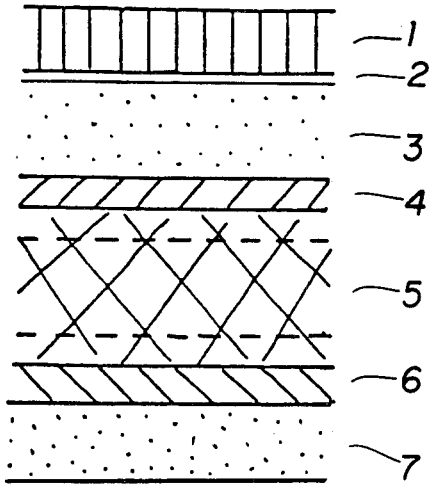

The paper support preferably comprises a fully-sized base paper, covered with a radiation-hardened coating of varnish. At least one barrier layer is inserted between the paper and the varnish layer. The base paper mainly consists of natural or synthetic pulp or mixtures thereof, it is waterproofed and provided with other conventional size and strengthening. Upon the base paper, which may be surface-sized, is placed the barrier layer described in detail below.

The permeablity of the barrier layer to acrylate monomer is preferably so slight that, on checking with a Hercules Sizing Tester, it takes more than 100 seconds before reflectance has dropped to 70%.

The barrier layer can, in accordance with the invention, be produced in different ways from different materials. Care must only be taken to ensure that, for an acrylate monomer, permeability does not fall below the value mentioned of 100 seconds, and that the coating contains only minimal quantities of free wetting agent, preferably no free wetting agent at all.

In a special embodiment, the barrier layer consists of a polyolefin film applied by extrusion coating. The thickness of the layer in this case is 5–30$\mu$, preferably 5–20$\mu$. The polyolefin is for example polypropylene or polyethylene or an ionomer resin or another ethylene copolymer resin. The barrier layer may, however, also consist of a mixture of the thermoplastic resins mentioned either with one another or with other thermoplastic resins. The outside barrier layer should preferably contain pigments.

In a further embodiment, the barrier layer is applied and dried as an aqueous solution of a water-soluble film-forming polymer. Suitable water-soluble polymers are for example polyvinyl alcohols, film-forming starch derivatives, film-forming cellulose derivatives, copolymers of acrylic acid with other vinyl monomers, alginates, casein, polyacrylamide, polystyrene sulphonate or mixtures of these polymers with one another or with other substances dissolved or dispersed in water. The thickness of the dried barrier coating, depending on the kind of polymer, is preferably between 3 and 30$\mu$.

In a third embodiment the barrier layer is manufactured from the aqueous dispersion of a polymerized substance which is insoluble in water or from a mixture of such a dispersion of polymerized substance with a water-soluble binding-agent dissolved in water. Suitable dispersions of polymerized substances are dispersions of ethylene polymers and copolymers, vinyl acetate copolymers and mixtures with one another of such dispersions of polymerized substances which, at the drying temperatures which are usual in the paper machine or in the coating machine, are film-forming. For manufacture from aqueous dispersion, the thickness of the dried barrier layer is preferably between 4 and 30$\mu$.

In principle, the barrier layer may contain all the conventional additives and auxiliaries such as pigments, dyestuffs, brighteners, plasticizers, electrolytes etc. Only the employment of large quantities of free wetting agents is excepted. In concrete terms, this means that the surface tension of an aqueous coating mixture should preferably not be less than 55 dyn.cm$^{-1}$. In particular, non-ionic wetting agents should, so far as possible, be avoided in the barrier layer.

A mixture which can be hardened by electron beams is applied to the barrier coating, either directly or after carrying out a pre-treatment to improve adhesion, and is solidified through the action of electron beams. If desired, after application of a pretreatment or a subbing layer, the usual photographic coatings can be applied to this coating hardened by electronic beams, on the basis of photo-catalytic redox systems, for example, silver-halide emulsion. The coating solidifed by means of electron beams contains, in addition to the binding agent, preferably pigments and if required, small quantities of dyestuffs and/or other additives. This coating has a weight per unit area of about 10 to 60 g/m$^2$, and preferably 15 to 40 g/m$^2$.

The hardenable mixture is applied using one of the known coating processes, equalized and, after covering with a protective gas, hardened by electron beams. It can, however, also, in accordance with DE-OS No. 30 22 709, be pressed after application against a profiling surface and then, without application of a protective gas, be solidified through the paper and barrier layers by means of electron beams. Finally, the layers on both sides can, in accordance with DE-OS No. 30 22 709, also be applied and at the same time solidified in one operation.

The binding agent of the coating which can be hardened by electron beams consists essentially of substances which typically, before hardening, contain C=C double bonds, e.g. in the form of acrylate or methacrylate groups. It can also contain smaller proportions of non-hardenable polymers, oligomers or lower-molecular substances, provided that such additives are significant for the improvement of specific properties and do not fundamentally alter the character of a mixture to be hardened by electron beams. Preferred pigments in a coating to be hardened by electron beams are white pigments, e.g. titanium dioxide, zircon oxide, zinc oxide, zinc sulfide, antimony oxide, barium sulfate, calcium carbonate and magnesium oxide. For special application purposes or out of considerations of taste, colored pigments, carbon black or soluble dyestuffs may be contained in the coating. The coating may, however, also be transparent.

In general, the reverse side of the multilayer support material manufactured in accordance with the invention is, likewise, coated with the barrier layer and the hardenable layer and, if the occasion requires, with additional layers. For simple applications, however, the multilayer construction according to the invention on one side is adequate.

Additional refinements of the invention are possible. In one variant an optical brightener, e.g. of the aminocoumarin type, as well as white pigment and, where appropriate, coloring pigment can be added to the mixture which can be hardened by electronic radiation to enhance the whiteness. It is further possible to dye the base paper and one side of the paper can be given a coating containing carbon black, while the other is given a white coating.

In one special form of embodiment, it is also possible to apply a coating of aqueous seal and to cover this, without intermediate drying, with a mixture which can be hardened by radiation. Surprisingly, the hardenable mixture can then also be hardened without disadvantageous accompanying phenomena because the water is first absorbed by the base paper and removed through the back of the paper after hardening is completed.

Papers with waterproof coatings on either side are, as a rule, given a seal coating and coating hardened by electronic radiation only on the side which is provided for coating with light-sensitive coatings. The reverse side can, as desired, be given a waterproof coating in accordance with one of the processes described in the literature. All known forms of surface treatment required for utilization of papers can be employed, i.e. roughness, suitability for tracing, anti-static properties and behavior on the roller are preferably controlled by means of coating on the reverse side.

One of several photographic layers based upon silver-halide emulsions for black and white or color photography are disposed over the upper layer hardened by electron beams, if need be after application of an additional intermediate coating.

The invention is explained in greater detail by means of the following examples.

EXAMPLE 1

A photographic layer base paper of approximately 80 g/m$^2$, sized with alkylketene dimer and polyamide epichlorhydrin resin, and surface-sized with a mixture of anionic starch and NaCl, is coated on both sides by extrusion coating with approximately 12 g/m$^2$ of a polyethylene mixture. The polyethylene mixture contains about 10% wt. titanium dioxide and 0.2% wt. cobalt violet pigment.

It has been found that the nature, thickness or molecular weight or possible mixtures with other thermoplastic substances have no influence upon the barrier action. Polyethylene deputizes for all extrudable thermoplastic polymers.

Parts of this polyethylene coated paper are then, after treatment of the polyethylene surfaces; coated on both sides in accordance with the process described in DE-OS No. 30 22 709 with 25 g/m$^2$ mixtures hardenable by radiation and the latter is solidified by electron beams. In the process, the coating on the one side, which is intermittently in contact with a polished cylinder, is solidified through the paper and the coating on the opposite side, after equalizing, is solidified under nitrogen acting as protective gas. Solidification is effected by electron beam using an energy dosage of 40 J/g. The hardenable mixture varnishes employed for the various tests on the sample were made up as follows:

(A)

51.60% wt. polyester
(M=about 1000 with 4 acrylic groups per m.w.)
13.00% wt. hexanediol diacrylate
19.00% wt. oligo triacrylate
(m.w.=480)
16.00% wt. titanium dioxide
(rutile type with organic surface treatment)
0.35% wt. cellulose aceto butyrate
0.05% wt. zinc ricinoleate (B)
18.00% wt. polyester acrylate
(M=about 1000 with 4 acrylate groups per m.w.)
18.00% wt. epoxy resin acrylate
(M=approx. 2400 with 2 acrylate groups per m.w.)
4.00% wt. 2-hydroxy ethyl acrylate
8.00% wt. tripropylene glycol diacrylate
20.00% wt. hexanediol diacrylate
20.00% titanium dioxide, rutile
(mean Ø0.32 μm stabilized with Al+Si)
10.00% wt. calcium carbonate
(surface-finished with Ca resinate)
0.0025% wt. tetrachlor thioindigo
0.0025% wt. phthalocyanine blue pigment
1.995% wt. perfluoro alkyl ester (FC 430)

(C)
25% wt. polyester acrylate
(M=about 1000 with 4 acrylate groups per m.w.)
12% wt. hexanediol diacrylate
8% wt. n-vinyl pyrrolidone
10% wt. polyester plasticizer from phthalic acid and ethylene glycol
5% wt. xylylene glycol diacrylate
40% wt. titanium dioxide, anatase
(mean particle diameter about 0.35 μm)

(D)
27% wt. aliphatic polyurethane acrylate
($\overline{M}$=about 4000 with 3 acrylate groups per m.w.)
16% wt. hexanediol diacrylate
3% wt. trimethylol propane triacrylate
4% wt. ethylene glycol monoacrylate
5% wt. aziridine
15% wt. titanium dioxide, anatase
30% wt. barium sulfate
(mean particle diameter about 0.8 μm)

(E)
5% wt. polystyrene resin
($\overline{M}$=about 325)
10% wt. vinyl acetate copolymer with vinyl stearate
5% wt. polyester plasticizer from phthalic acid and gylcol
20% wt. tripropylene glycol diacrylate
30% wt. hexanediol diacrylate
10% wt. trimethylol propane triacrylate
4% wt. ethylene glycol monoacrylate
16% wt. titanium dioxide, rutile (F)
29% wt. polyester acrylate
($\overline{M}$=about 1000 with 4 acryl groups per m.w.)
9% wt. oligo triacrylate
6% wt. hexanediol triacrylate
6% wt. n-vinyl pryyolidone
50% wt. titanium dioxide, rutile (G)
40% wt. epoxy resin diacrylate
10% wt. pentaerythritol triacrylate
12% wt. hexanediol diacrylate
7.8% wt. cyclohexyl acrylate
0.2% wt. ethyl triphenyl phosphorane
30% wt. titanium dioxide, anatase

EXAMPLE 2

A photographic base paper, about 110 g/m$^2$ and sized as in Example 1 is coated on both sides using a doctor blade with a mixture of the following composition and dried:

60% wt. 50% polymerized product dispersion consisting of ethyl acrylate/vinyl acetate/acrylic acid copolymer
10% wt. sodium polystyrene sulphonate
($\overline{M}$=about 40,000)
1% wt. sodium polyacrylate
($\overline{M}$=about 5,000)
0.5% wt. conc. $NH_3$ solution
18% wt. water
10% wt. titanium dioxide anatase
0.5% wt. paper blue dyestuff
(Bayer paper blue S)

The dried barrier layer coating has a weight per unit area on either side of about 15 g/m$^2$. It is smoothed with a calendering device and covered on each side with 20 g/m$^2$ of prescription F from Example 1, which is hardened with electron beams.

EXAMPLE 3

A photographic base paper, about 130 g/m$^2$ and sized as in Example 1, is coated inside a paper machine using a twinblade coating device with a solution of the following composition:

14% wt. hydroxy propyl starch ether
(Solfarex A 115 from Scholtens Chemische Fabrieken)
5% wt. sodium salt of a 1:1 styrene/maleic acid anhydride copolymer
0.1% wt. Remastralblau FFRL
(dioxazine dyestuff from Farbwerke Hoechst AG)
80.9% wt. water The barrier layer coating obtained after drying and smoothing has a weight per unit area on either side of about 7 g/m$^2$. The paper thus pre-coated is subsequently given a coating, which is hardened by electron beam, based on prescription F from Example 1, of 30 g/m$^2$ on either side.

EXAMPLE 4

A photographic base paper about 100 g/m$^2$ and sized as in Example 1, is coated on one side with a mixture of the following composition:

20% wt. ethylene/vinyl acetate (30/70) copolymer dispersion (50%)
8% wt. polyvinyl alcohol, medium viscous
2% wt. sodium alginate, medium viscous
10% wt. titanium dioxide, anatase
60% wt. water After drying the coating is about 10 g/m$^2$. The dried coating is smoothed with the aid of a heated calendar roller and covered with about 20 g/m$^2$ of a hardenable mixture in accordance with prescription F in Example 1, pressed against a highly-polished cylinder and soldified from the uncoated side of the paper using an electron beam with an energy consumption of 40 J/g.

EXAMPLE 5

A photographic base paper, about 70 g/m$^2$, sized with epoxidated di-fatty acid amide (R=$C_{14}$ or greater), starch/polyacrylamide and aluminum stearate, is coated in the size press of the paper machine on both sides with a mixture of the following composition:

20% wt. polyester resin dispersion, 30%
5% wt. sodium cellulose sulfate
(degree of substitution about 1.5)
10% wt. titanium dioxide, anatase
65% wt. water After drying and smoothing, the coating is about 6 g/m$^2$ on either side.

The pre-coated paper is coated on one side with about 25 g/m$^2$ of a hardenable mixture in accordance with prescription F in Example 1, the unhardened mixture is pressed against a highly polished cylinder and solidified from the uncoated side of the paper using electron beams with 40 J/g. Then the other side is coated with about 25 g/m$^2$ of a hardenable mixture of the following composition:

40% wt. polyester acrylate
($\overline{M}$=about 1000 with 4 acrylgroups per m.w.)
12% wt. hexanediol diacrylate
13% wt. oligotriacrylate
10% wt. titanium dioxide, rutile
25% wt. gas black The coating is solidified under nitrogen using electron beams with an energy dosage of 30 J/g and forms the back of the photographic carrier.

EXAMPLE 6

A photographic base paper, about 170 g/m$^2$, sized with alkyl ketene dimer, aluminium stearate, gelatine and polyamide epichlorhydrin resin, is coated with a coating mixture which, after drying, has the following composition:

30% wt. of a 40% dispersion of a copolymer of 40:55:5 styrene/ethyl acrylate/acryl amide
8% wt. gelatine
1% wt. polyacryl amide
20% wt. kaolin
41% wt. barium sulfate The weight per unit area of the barrier coating is about 25 g/m$^2$ on each side. The pre-coated paper is smoothed and coated on one side with 15 g/m$^2$ hardenable mixture in accordance with prescription F, Example 1. The mixture is pressed against a highly polished cylinder and solidified from the back using electron beams with 50 J/g.

EXAMPLES 7-12 (FOR COMPARISON)

As Examples 7-12 for comparison, the untreated papers used in Examples 1-6, without prior application for the barrier layers, were coated directly with the mixtures which can be hardened by radiation specified in the examples. In the process, the coating weight was in each case increased by half the weight of the barrier layer. The coatings were solidified in the corresponding examples with electron beams using the energy dosage specified in the examples.

EXAMPLE 13 (FOR COMPARISON)

As comparison Example 13, a photographic carrier paper was taken, coated in accordance with standard procedures on both sides with polyethylene, and was then coated in accordance with comparison Example A from DOS No. 30 22 451, in front with a 15/85 mixture of titanium dioxide/polyethylene, and at the back with a non-pigmented polyethylene layer.

TESTING THE SUPPORT MATERIALS

Using hexanediol diacrylate as a testing medium (HDDA), the effect of the barrier layers was determined with a Hercules Sizing Tester. The device and its functioning are described in the brochure, "Hercules Degree of Sizing Tester", from Hercules NV, The Hague, Holland. Such tests were carried out in each case before application of the hardenable coating to the papers.

The effect of the barrier layers upon fog and sensitivity of the photographic layers was determined in a twofold manner. In the first place, samples of the examples and comparison examples coated with radiation-hardened layers and samples of the related base papers were laid between two sheets of commercial grade photographic silver bromide paper and so stored in darkness for four days at 60° C. and 80% relative humidity. During this contact storage test, the sheets were exposed to a compressive load application of about 300 g/m$^2$. After the lapse of the 4-day contact test, the test pieces were taken out and the photographic papers which had been in contact with the test pieces were exposed to a medium grey tone and developed, and those areas which had been in contact with the test pieces were compared with the surrounding areas. Possible deviation in the grey tone was evaluated and noted in a six-stage scale, signifying:

1—no deviation
2—scarcely visible deviation
3—visible deviation
4—clear deviation
5—marked deviation
6—extreme deviation Deviation from the comparison grey tone always appeared as sensitization, i.e. darker.

For the second photographic test, papers covered with radiation-hardened coatings were coated after corona treatment of the surface, with a conventional fine-grained black-and-white silver halide emulsion layer with high resolution.

Parts of the light-sensitive papers thus produced were packed in light-proof packing and stored for a year at room temperature. They were then developed in the standard way and the fog which had arisen in each case measured with the densitometer. Measurement values obtained are shown with the other test data in Table 1.

Other parts of the light-sensitive papers, manufactured as described, were exposed through a test negative and developed and fixed in the conventional manner.

The test negative employed was a screen of lines, made in the form of a graphical wedge. From the course of optical density over the graphical wedge, the projected screen of lines makes it possible to achieve comparative findings on the image sharpness of definition of the different test pieces. The relative figures on image sharpness are likewise presented in Table 1. All values are related to the test piece with the image sharpness which is relatively highest (i.e., Example 1 F=100%).

TABLE 1

| Photographic Test Results and Transmissibility of the Barrier Layer | | | | |
|---|---|---|---|---|
| Sample No. | Contact Storage Test (Mark) | Fog After 1 Year of Deposition | Relative Image Sharpness (%) | Permeability Test with HDDA, HST 70% Reflectiveness |
| Example | | | | |
| 1 A | 1–2 | 0.10 | 78 | >>300 sec. |
| 1 B | 1–2 | 0.12 | 90 | >>300 sec. |
| 1 C | 1 | 0.10 | 96 | >>300 sec. |
| 1 D | 1–2 | 0.10 | 82 | >>300 sec. |
| 1 E | 2 | 0.13 | 78 | >>300 sec. |
| 1 F | 1–2 | 0.11 | 100 | >>300 sec. |
| 1 G | 1–2 | 0.11 | 92 | >>300 sec. |
| 2 | 2–3 | 0.14 | 100 | 260 sec. |
| 3 | 2–3 | 0.16 | 98 | 150 sec. |
| 4 | 2 | 0.12 | 96 | 200 sec. |
| 5 | 2 | 0.10 | 98 | 120 sec. |
| 6 | 1–2 | 0.12 | 94 | >300 sec. |
| Comparison Example | | | | |
| 7 A | 3–4 | 0.32 | 80 | 2 sec. |
| 7 B | 3–4 | 0.34 | 92 | 2 sec. |
| 7 C | 3–4 | 0.30 | 96 | 2 sec. |
| 7 D | 3–4 | 0.30 | 84 | 2 sec. |
| 7 E | 4 | 0.34 | 80 | 2 sec. |
| 7 F | 3–4 | 0.32 | 98 | 2 sec. |
| 7 G | 3–4 | 0.32 | 92 | 2 sec. |
| 8 | 4 | 0.34 | 98 | 3 sec. |
| 9 | 3–4 | 0.41 | 100 | 4 sec. |
| 10 | 3–4 | 0.32 | 94 | 3 sec. |
| 11 | 4 | 0.30 | 96 | 2 sec. |
| 12 | 3–4 | 0.38 | 98 | 4 sec. |
| 13 | 2 | 0.13 | 70 | — |
| Example 1 from DOS 30 46 130 | 3 | 0.26 | 80 | — |
| Uncoated Base Paper | | | | |
| to 1 & 7 | 1–2 | 0.10 | | |
| to 2 & 8 | 2 | 0.10 | | |
| to 3 & 9 | 2 | 0.10 | | |
| to 4 & 10 | 1–2 | 0.10 | | |
| to 5 & 11 | 1 | 0.07 | | |
| to 6 & 12 | 1–2 | 0.09 | | |

What we claim is:

1. A waterproof, paper support material for photographic coatings comprising:

a photographic base paper, a coating of electron beam radiation-hardened varnish on said paper for receiving the photographic coating thereon, said coating including C=C bonds before radiation hardening, and a barrier layer having a low permeability to acrylate monomer sufficient to substantialy reduce the fogging of a photographic coating, when present, which fogging would otherwise result due to contact of said radiation hardened varish and said base paper, said barrier layer being arranged between said paper and said varnish coating.

2. The paper support of claim 1, wherein said barrier layer has a permeability to acrylate monomer of at least 100 seconds, and is free of free wetting agent.

3. The paper support of claim 1, wherein said barrier layer has a thickness of 3–30μ.

4. The paper support of claim 3, wherein said thickness is 4–20μ.

5. The paper support of claim 1, wherein said barrier layer comprises a polymer selected from the group consisting of film-forming material applied by extrusion coating, a coating of an aqueous solution and an aqueous dispersion.

6. The paper support of claim 1, wherein said barrier layer contains ingredients selected from the group consisting of pigments, dyestuffs, brighteners, plasticizers, electrolytes and additives.

7. The paper support of claim 5, wherein said barrier layer contains white pigments from the group consisting of titanium dioxide, zircon oxide, zinc oxide, zinc sulfide, antimony oxide, barium sulfate and calcium carbonate.

8. The paper support of claim 4, wherein said barrier layer is selected from the group consisting of polyolefin and polyolefin copolymer.

9. The paper support of claim 4, wherein said barrier layer is selected from the group consisting of acrylate, methacrylate and copolymers thereof.

10. The paper support of claim 4, wherein said barrier barrier layer comprises a film-forming starch derivative with a proportion of a synthetic film-forming polymer.

11. The paper support of claim 4, wherein said barrier layer is selected from the group consisting of polyvinyl alcohol or a combination thereof with other polymers which are either water-soluble or dispersible in water.

12. The paper support of claim 1, wherein said paper is a sized paper.

13. A process for the manufacture of a waterproof support material for photographic coatings comprising:

applying a barrier layer having a low permeability to acrylate monomer on at least one surface of a photographic base paper;

coating said barrier layer with a coatable mixture including C=C bonds which is capable of being radiation hardened by electron beam and of receiving the photgraphic coating thereon when hardened; and hardening said coatable mixture above the barrier layer with an electron beam, said low permeability to acrylate monomer of said barrier layer being sufficient to substantially reduce the fogging of a photographic coating, when persent, which fogging would otherwise result due to contact of the radiation hardened coating with the base paper.

14. The process of claim 13, including:

applying said barrier layer on at least one surface of said base paper;

pre-treating the surface of said barrier layer to improve the adhesion of the hardenable coating which is to be subsequently applied thereto;

coating the treated surface of said barrier layer with the hardenable, coatable mixture; and hardening said coatable mixture above the barrier layer with an electron beam.

15. The process of claim 13, wherein said barrier layer is a thermoplastic resin which is extrusion coated to form said layer.

16. The process of claim 14, wherein said barrier layer is a thermoplastic resin which is extrusion coated to form said layer.

17. The process of claim 13, wherein said barrier layer is formed by the application of an aqueous solution or dispersion of a film-forming substance or mixture of such substances with subsequent drying.

18. The process of claim 14, wherein said barrier layer is formed by the application of an aqueous solution or dispersion of a film-forming substance or mixture of such substances with subsequent drying.

19. The process of claim 14, wherein the pre-treatment of the surface of the barrier layer includes oxidation.

20. The process of claim 19, wherein said oxidation is by corona treatment.

21. The process of claim 14, wherein the pre-treatment of the barrier layer is a separate adhesion coating.

22. The process of claim 13, wherein the hardened coating is hardened by an electron beam with an energy dosage of 5–60 Joules/g.

23. The process of claim 14, wherein the hardened coating is hardened by an electron beam with an energy dosage of 5–60 Joules/g.

24. The process of claim 13, wherein the surface of the hardened coating is also pre-treated to improve adhesion, and a photographic coating is applied to the pre-treated surface of the hardened coating.

25. The process of claim 14, wherein the surface of the hardened coating is also pre-treated to improve adhesion, and a photographic coating is applied to the pre-treated surface of the hardened coating.

26. The process of claim 14, including the steps of:

applying a coating consisting essentially of polyolefin to both surfaces of a base paper, pre-treatment of at least one of the surfaces of the polyolefin coatings by oxidation;

coating the pre-treated polyolefin surface with a coatable mixture which is hardenable by an electron beam; and hardening the coatable mixture with an electron beam.

27. The process of claim 13, wherein said hardenable, coatable mixture is brought into contact with a profiling surface, is then hardened through the paper by the electron beam, and is subsequently separated from the profiling surface.

28. The process of claim 14, wherein said hardenable, coatable mixture is brought into contact with a profiling surface, is then hardened through the paper by the electron beam, and is subsequently separated from the profiling surface.

29. The process of claim 26, wherein said hardenable, coatable mixture is brought into contact with a profiling surface, is then hardened through the paper by the electron beam, and is subsequently separated from the profiling surface.

30. The process of claim 13, wherein said hardenable, coatable mixture is brought into contact with the profiling surface, is then hardened by the electron beam through the profiling surface, and is subsequently separated from the profiling surface.

31. The process of claim 14, wherein said hardenable, coating mixture is brought into contact with the profiling surface, is then hardened by the electron beam through the profiling surface, and is subsequently separated from the profiling surface.

32. The process of claim 26, wherein said hardenable, coatable mixture is brought into contact with the profiling surface, is then hardened by the electron beam through the profiling surface, and is subsequently separated from the profiling surface.

33. The process of claim 13, wherein said paper is a sized paper.

* * * * *